US006120175A

United States Patent [19]

Tewell

[11] Patent Number: 6,120,175

[45] Date of Patent: Sep. 19, 2000

[54] APPARATUS AND METHOD FOR CONTROLLED CHEMICAL BLENDING

[75] Inventor: Stanley Tewell, Manchaca, Tex.

[73] Assignee: The Porter Company/Mechanical Contractors, Manchaca, Tex.

[21] Appl. No.: 09/352,981

[22] Filed: Jul. 14, 1999

[51] Int. Cl.[7] ..... B01F 13/10; B01F 15/02

[52] U.S. Cl. ..... 366/140; 366/141; 366/177.1; 366/189; 366/152.1

[58] Field of Search ..... 366/140, 141, 366/150.1, 152.1, 136, 137, 132, 134, 131, 162.1, 162.3, 160.1, 336, 177.1, 181.5, 181.6, 182.1, 184, 187, 189, 194

[56] References Cited

U.S. PATENT DOCUMENTS

| | | | |
|---|---|---|---|
| 2,343,454 | 3/1944 | Harnett | 366/141 |
| 4,241,023 | 12/1980 | Wilke et al. | 366/162.1 |
| 4,399,105 | 8/1983 | Tilgner et al. | 366/152.1 |
| 4,403,866 | 9/1983 | Falcoff . | |
| 4,494,413 | 1/1985 | Bukkems et al. | 366/140 |
| 4,509,863 | 4/1985 | Borrow . | |
| 4,671,892 | 6/1987 | Bereiter . | |
| 5,288,145 | 2/1994 | Mackey . | |
| 5,340,210 | 8/1994 | Patel . | |
| 5,369,032 | 11/1994 | Pratt | 366/141 |
| 5,409,310 | 4/1995 | Owczarz . | |
| 5,522,660 | 6/1996 | O'Dougherty . | |
| 5,558,435 | 9/1996 | Marjo . | |
| 5,833,364 | 11/1998 | Rushing et al. | 366/141 |
| 5,980,836 | 11/1999 | Moffett et al. | 366/152.1 |

*Primary Examiner*—Tony G. Soohoo

*Attorney, Agent, or Firm*—J. Nevin Shaffer, Jr.; Shaffer & Culbertson, LLP

[57] ABSTRACT

A chemical blending system having more than one chemical blending vessel (12, 12') with inlets at the top. A pair of automatic inlet valves are connected to the top of each chemical blending vessel, one with a large inlet orifice and one with a relatively much smaller inlet orifice. At least two chemical batch tanks are connected to the pair of automatic inlet valves and chemicals to be mixed are delivered there at high speed by pumps. Weight cell devices (30) are attached to the bottom of each blending vessel. A controller/computer is connected for the automatic control of pumps (28, 36) and valves (20, 50, 58). A discharge line is connected to the bottom of blending vessels and to a receiving station, and includes pulsation dampeners (38), filters (40) and static mixers (42). A sampling device (46) is connected a recirculation line for the sampling of the blended chemical during recirculation and prior to delivery. Drain valve and drain line are connected to the bottom of the blending vessel for the draining and delivery of unused chemical to remote recovery tank (54). When one blending vessel is delivering appropriately blended chemical, another chemical blending vessel is being filled so that an essentially continuous, uninterrupted supply of appropriately and quickly blended chemical is available.

13 Claims, 2 Drawing Sheets

APPARATUS AND METHOD FOR CONTROLLED CHEMICAL BLENDING

BACKGROUND OF THE INVENTION

This invention pertains to an apparatus and method for controlled chemical blending in general. In particular, the invention provides for the high speed chemical blending of a variety of chemicals through a pair of automatic inlet valves, one with a large inlet orifice and one with a relatively much smaller inlet orifice. The processes used in semiconductor manufacturing require the blending of two or more chemicals in the ordinary case. The correct percentage of each chemical in the blend is critical and typically must be within a tolerance of 0.5% by weight. Not only is the correct percentage of the blend critical, but rapidly obtaining and maintaining the mixture is important as well. A third problem faced is the need to change the mixture at any time. The prior art discloses a variety of devices designed for mixing. The Falcoff, et al patent, U.S. Pat. No. 4,403,866 discloses a process for making paints which meet the requirements of a standard paint formula loaded in a computer. A colorimeter is used to determine whether the paint is within the tolerance values of the standard paint.

The Borrow patent, U.S. Pat. No. 4,509,863 discloses an apparatus for mixing milk with flavoring and fluoride. The device consists of two sets of three vessels. The three vessels are constructed so that their internal volumes are in the same ratio as the volumes of liquid in the final beverage.

The Beerier patent, U.S. Pat. No. 4,671,892 discloses a device for making soap on site by first weighing the materials to be mixed, then mixing them and transferring the mixture for storage at the end of a predetermined reaction time.

More directly related prior art patents are disclosed in Mackay, et al, U.S. Pat. No. 5,288,145, for a device that monitors the weight of a mixing tank as various switches are actuated to add the required ingredients. No precise requirements of mixing are disclosed and the control over dilution is accomplished by varying the speed of the pump adding the dilutant.

The Patel, et al patent, U.S. Pat. No. 5,340,210 discloses a device for blending chemicals which includes a single blending vat and a pump that includes forward and reverse directions and has a high and low speed function. The Patel vat is initially filled at high speed and, prior to the introduction of the full amount of chemical to be blended, is shifted to the low speed for the precise addition of chemical. This system is mirrored by the Major patent, U.S. Pat. No. 5,558,435 and the O'Dougherty, et al patent, U.S. Pat. No. 5,522,660.

Other means and methods exist for the creation of a proper chemical blend by dilution and otherwise such as disclosed in the Owczarz patent, U.S. Pat. No. 5,409,310, which utilizes aspirator injectors which have a suction port which draws from a mixing tank so that as a primary fluid flows through the aspirator injectors, the already diluted additive is further diluted.

A primary drawback of the chemical blending systems known in the art is the inability to create accurate chemical blends within a very narrow range of tolerance at high speed. Other drawbacks are the inability to obtain the desired chemical balance quickly and accurately and maintain a constant flow of the blend as required. Further, the prior art points out the need for a chemical blending system that also has the ability to rapidly and actively change chemical blends when desired. It, therefore, is an objective of the chemical blending system of the present invention to provide for a continuously high speed apparatus and method of creating chemical blends within a very small range of tolerance by weight that is capable of manipulation of the chemical blend so as to obtain and maintain the proper mixture over time and which can change the blend as desired.

SHORT STATEMENT OF THE INVENTION

Accordingly, the chemical blending system of the present invention includes more than one chemical blending vessel with tops and bottoms and with inlets at the tops. A pair of automatic inlet valves is connected to each chemical blending vessel, one with a large inlet orifice and one with a relatively much smaller inlet orifice. At least two chemical batch tanks for holding chemicals to be blended are connected to the pair of automatic inlet valves. A pump is connected to the chemical batch tanks for high speed delivery of chemicals from the chemical batch tank to the automatic inlet valves. A controller for controlling the transfer of chemicals and opening and closing the automatic inlet valves is connected to the system and to a weight cell which is utilized for measuring the weight of chemicals added to the chemical blending vessels. Further, a discharge line is connected to the bottom of each of the chemical blending vessels and to a receiving station. The discharge line contains a static mixer and is connected to a discharge line pump, a filter, and a sampling means so that a resultant blend of chemicals is mixed, filtered and sampled after discharge from the chemical blending system and prior to delivery to the receiving station.

Further embodiments of the invention include chemical blending vessels with cone shaped bottoms so as to mechanically induce blending of the chemicals as they are added at high speed from the tops and so as to assist in the complete evaluation of chemicals when desired. Further, in a preferred embodiment, a separate pair of automatic inlet valves is provided for use by each individual chemical blending tank that is connected to the system. In a further embodiment, a back-up discharge line pump is provided that is interconnected between the chemical blending vessels so that auxiliary discharge line pump action is available. Still, in a further embodiment, a drain is connected to the bottom of the chemical blending vessels and to a blended chemical recovery tank for the high speed drain of said chemical blending vessels when necessary.

A corresponding chemical blending method is provided as disclosed and claimed more fully hereafter which includes the step of filling the chemical blending vessel at high speed until a majority of the desired chemical has been received as determined by a weight cell, at which point a controller switches the automatic inlet valve with a relatively much smaller inlet orifice for the final high speed delivery of the minority of the desired chemical as determined by weight. In a further preferred embodiment of this method, the step includes the step of high speed addition of 97% of the desired chemical by weight through the first automatic inlet valve with a large inlet orifice and the addition of the remaining 3% of the desired chemical through the automatic inlet valve with a relatively much smaller inlet orifice.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
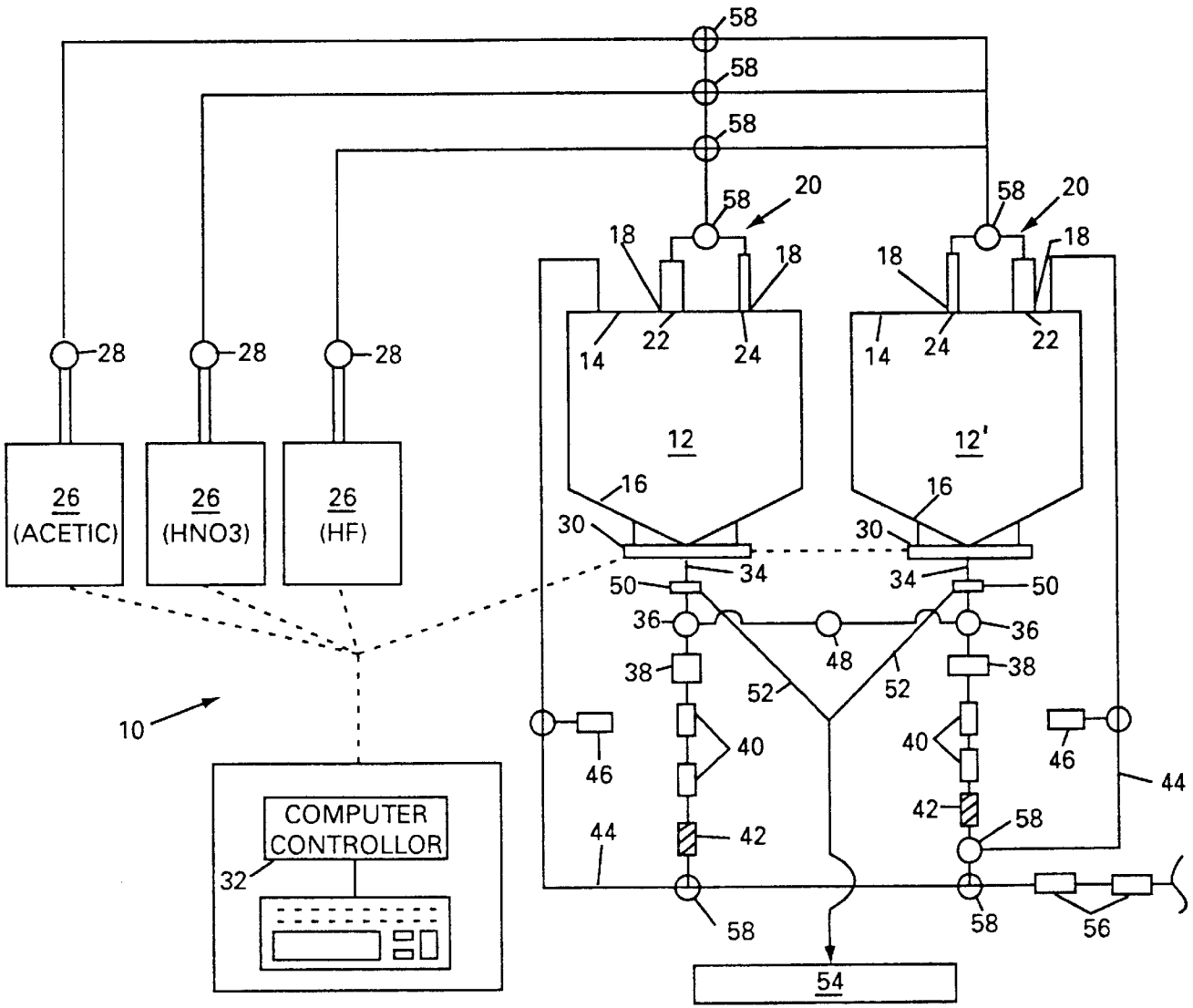
FIG. 1 is a schematic diagram of a preferred embodiment of the chemical blending system of the present invention.
Figure 2:
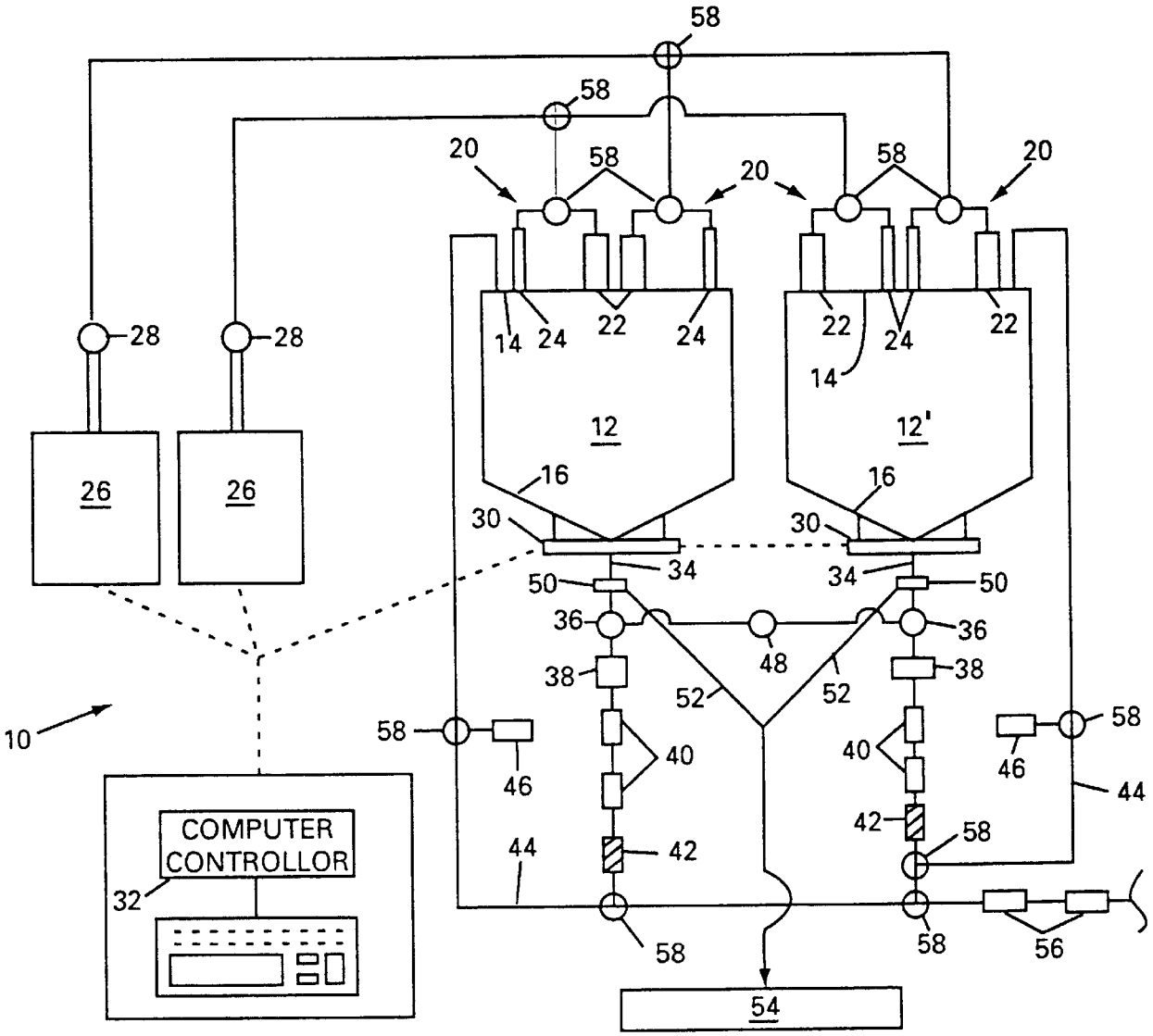
FIG. 2 is a schematic diagram illustrating another preferred embodiment of the invention disclosed in FIG. 1.

The preferred embodiment of the present invention is illustrated by way of example in FIGS. 1–2. With specific reference to FIG. 1, a chemical blending system 10 includes chemical blending vessels 12 with tops 14 and bottoms 16. Tops 14 have inlets 18. Connected to inlets 18 are automatic inlet valves 20. Automatic inlet valves 20 comprise a pair of inlet valves, one automatic inlet valve 22 with a large inlet orifice and one automatic inlet valve 24 with a relatively much smaller inlet orifice. Chemical batch tanks 26 are connected through pumps 28 to automatic inlet valves 20. Chemical blending vessels 12 are connected to and rest upon weight cell devices 30. Controller (computer) 32 is connected to weight cell devices 30 and to chemical blending system 10 for the remote control and operation of chemical blending system 10, including all pumps, valves and associated electronic and mechanical equipment.

Discharge line 34 is connected to the bottom 16 of chemical blending vessel 12 and, ultimately, to the remote receiving station (not shown). Discharge line 34 includes discharge line pumps 36, pulsation dampeners 38, filters 40, and static mixer 42. Additionally, discharge line 34 includes recirculation line 44 connected to the top 14 of chemical blending vessel 12. Recirculation line 44 includes sampling device 46.

In a preferred embodiment, discharge line 34 further includes a third alternate discharge line pump 48 as back-up. Further, discharge line 34 includes drain valves 50 and drain lines 52 connected to remote blended chemical recovery tank 54. Prior to delivery to the remote receiving station, discharge line 34 further includes receiving station filters 56. As shown in FIGS. 1 and 2, the bottom 16 of chemical blending vessels 12, preferably, is conical in shape.

Referring now to FIG. 2, another preferred embodiment of the present invention is illustrated wherein chemical batch tanks 26 are connected through pumps 28 to individual pairs of automatic inlet valves 20. As a result, automatic inlet valves 20 can be constructed to accommodate a particular chemical, thereby reducing the corrosive effect over time of switching chemicals from batch to batch through a single pair of automatic inlet valves 20.

In general, the chemical blending system 10 of the present invention introduces chemicals from chemical batch tanks 26 into chemical blending vessels 12, one at a time, through automatic valves 58 controlled by controller/computer 32. Controller/computer 32 directs the selected chemical from one of the chemical batch tanks 26 to automatic inlet valve 20. Automatic inlet valve 20, again, consists of a pair of inlet valves, valve 22 with a large inlet orifice and valve 24 with a relatively much smaller inlet orifice. Valve 22 is utilized for introducing the bulk flow of the chemical at high speed to chemical blending vessel 12. Valve 24, again sized with a smaller orifice, allows precise control, but still at high speed, of the chemical to be delivered, and is utilized to complete the flow. The point is, pump 28 runs at the same speed for the entire process and the precise addition of chemicals is accomplished through selective use of valves 22 and 24. Controller 32 constantly measures the weight of chemical adding through feedback from weight cell device 30. After the majority of the chemical by weight has been added through valve 22, controller 32 automatically closes valve 22 and opens valve 24 for the high speed introduction of the remainder of chemical required up to the required weight as measured by weight cell device 30. In a preferred embodiment, valve 22 is utilized so as to allow chemical flow until approximately 97% of the required weight is added to chemical blending vessel 12. Thereafter, valve 24 is opened to fill the remaining 3% of the required weight. Obviously, these percentages can be adjusted through the controller 32 as required. Valves 22 and 24 can be opened and closed manually, as is known in the art. The required weights of each chemical for whatever chemical blend is desired is determined beforehand and controlled through programmable logic controller/computer 32. Further, controller 32 can be any computer now known or hereafter developed.

By means of the present invention then, high speed delivery of chemicals to be blended is enabled since the automatic inlet valve 22 with a large inlet orifice is automatically cut off when the appropriate initial, major, percentage of chemical by weight is achieved and the automatic inlet valve 24 with a relatively smaller orifice is opened and flow is controlled by the size of the orifice, not the speed of the pump. Again, this enables the delivery and mixing of chemicals, from the majority of the chemical to be mixed through the remaining minority, all of it at high speed.

Once the chemical blending vessel 12 has received all of the required chemicals at the required weight percentages, further mixture is accomplished by circulating the mixture from chemical blending vessel 12 through discharge line 34, by means of discharge line pump 36, through pulsation damper 38, filters 40 and static mixer 42. Prior to delivery to the remote receiving station, the blended chemical is directed by controller 32 through recirculation line 44 and, at that point, sampling device 46 is utilized to sample the chemical so as to determine whether the correct chemical blend has been achieved. Any known chemical analyzer can be used for sampling. Correction of the chemical blend can then be accomplished so as to prevent the delivery of an inaccurate or unacceptable blend to the remote receiving station. Once the desired chemical blend is achieved in one of the chemical blending vessels 12, controller 32 opens automatic valve 58 in discharge line 34 so as to direct the chemical blend through receiving station filters 56 for ultimate delivery to the receiving station. As illustrated, each chemical blending vessel 12 has its own dedicated pump 36, as well as a third/alternate discharge line pump 48 which is used as a common spare.

By way of further example, the use of the system for mixing an acid comprised of HF, HNO3 and Acetic will be discussed. To begin with, the chemical weight required for the mixture is programmed and set through the controller 32. Once set, HF is allowed to flow, by means of pump 28 through a connection line and, by means of automatic valve 58 into blending vessel 12 through automatic inlet valve 20. To begin with, the HF flows through valve 22 with a large inlet orifice. Once chemical blending vessel 12 receives 97%, or any other percentage as required for rapid filing, of the required weight of HF, valve 22 is automatically closed and fine control valve 24 is opened to allow the final 3% of HF to reach the required weight as determined by weight cell 30. After chemical blending vessel 12 receives the appropriate weight of HF, HNO3 is flowed through automatic valve 58 to automatic inlet valves 20 and initially through valve 22 with a large inlet orifice. Once chemical blending vessel 12 receives 97% of the required weight of HNO3, valve 22 is automatically closed and fine control valve 24 is opened to allow the final 3% of HNO3 to reach the required weight. After the chemical blending vessel 12 receives the required HNO3 by weight, the Acetic is flowed through valve 22 into chemical blending vessel 12. Once chemical blending vessel 12 receives 97% of the required weight of Acetic, valve 22 is automatically closed and fine control valve is automatically opened to allow the final 3% of Acetic to reach the required weight. As can be seen, the weight cell 30, in conjunction with controller 32 through automatic operation of appropriate valves, controls the required weight of each chemical.

Once the chemical blending vessel 12 reaches the required capacity and blend, discharge line pump 36 starts and the mixture is pumped through pulsation damper 38, filters 40, static mixer 42 and back to chemical blending vessel 12 through recirculation line 44. At this point, sampling device 46 is utilized to determine whether the correct chemical blend has, in fact, been achieved. The chemical blend will continue to recirculate until adequate mixing, or formulation is acquired. At this point, the chemical blend is ready for distribution. When distribution is required, automatic valve 58 in discharge line 34 directs the chemical blend through receiving station filters 36 and on to the receiving station for utilization.

When chemical blending vessel 12 has completed its "fill" operation as just described, chemical blending vessel 12' begins filling in the same sequence as just described. Once chemical blending vessel 12' has reached the required chemical blend mixture, discharge line pump 36 connected with chemical blending vessel 12' starts and the mixture is pumped through pulsation damper 38, filters 40 and static mixer 42 associated with chemical blending vessel 12' back through recirculation line 44 to the top of chemical blending vessel 12'. It should be noted that in addition to this means for blending the chemical, the introduction of the chemical at the top, in conjunction with the conical shape of the bottom 16, of chemical blending vessels 12 and 12' also ensures thorough mixing of chemicals. Once the chemical blend has been sampled by means of sampling device 46 and found to meet the required specifications, the chemical blend goes to distribution as previously discussed through receiving station filters 56.

By way of a further embodiment of the present invention, when chemical blending vessel 12 reaches a low point, as previously determined by the operator through controller 32, drain valve 50 is automatically opened while associated outlet valves and pumps and discharge line 34 are closed, so as to allow any remaining chemical blend to drain from the chemical blending vessel 12 to remote chemical recovery tank 54. Here, the conical shape of the bottom 16 enhances the ability of the chemical blending vessels 12 to drain rapidly and completely. Simultaneously, when chemical blending vessel 12 is draining, chemical blending vessel 12' will be full and ready to deliver appropriately blended chemical. If distribution is not needed, chemical blending vessel 12' will continue to recirculate. When chemical blending vessel 12 is sufficiently drained, and cleaned as necessary and desired, the filling process begins again.

When chemical blending vessel 12' reaches a low point, the discharge line 34 is closed and the drain line 50 is automatically opened to allow it to drain. When chemical blending vessel 12' reaches a low point in the delivery of appropriately blended chemical, chemical blending vessel 12 will be full with appropriately mixed and blended chemicals so that chemical blending vessel 12' will be stopped and delivery from chemical blending vessel 12 will be initiated if needed. As result, an essentially uninterrupted, continuous flow of appropriately blended chemical is provided to the remote receiving station.

Obviously, any number of chemical batch tanks 26 can be utilized, as well as any number of chemical blending vessels 12, 12', and the like. Further, while the chemical blending system 10 of the present invention has been disclosed in connection with the accurate chemical mixing and blending of chemicals for use in the semiconductor industry, it should be appreciated that the blending system of the present invention can be used in other applications. The present invention provides an accurate, multiply efficient means for blending fluids rapidly and automatically and provides an essentially uninterrupted continuous flow of mixed product as desired. Thus, the blending system of the present invention has important advantages over the prior art for accuracy, efficiency, and continuity of delivery of blended materials.

While the present invention has been disclosed in connection with the preferred embodiment thereof, it should be understood that there may be other embodiments which fall within the spirit and scope of the invention as defined by the following claims.

What is claimed is:

1. A chemical blending apparatus comprising:

(a) more than one chemical blending vessel with tops and bottoms and with inlets at the tops;

(b) a pair of automatic inlet valves connected to each chemical blending vessel, one automatic inlet valve with a large inlet orifice and one automatic inlet valve with a relatively much smaller inlet orifice;

(c) at least two chemical batch tanks for holding chemicals to be blended, each chemical batch tank connected to said pair of automatic inlet valves;

(d) a pump connected to said chemical batch tanks for high speed delivery of chemicals from said chemical batch tanks to said automatic inlet valves;

(e) a weight cell means for measuring the weight of chemicals added to said chemical blending vessels, connected to said chemical blending vessel;

(f) a controller means for controlling the transfer of chemicals and opening and closing said automatic inlet valves, connected to said weight cell means; and (g) a discharge line connected to the bottoms of said chemical blending vessels and to a receiving station, containing a static mixer and connected to a discharge line pump and a filter and sampling means so that a resultant blend of chemicals is mixed, filtered, and sampled after discharge from said chemical blending vessels and prior to delivery to said receiving station.

2. The apparatus of claim 1 further comprising:

(a) cone shaped bottoms on said chemical blending vessels; and (b) a recirculation line connected to said discharge line so that the chemical blend can be pumped from the chemical blending vessel through the static mixer, filter and sampling means and back to the chemical blending vessels without delivery to said receiving station.

3. The apparatus of claim 1 further comprising a separate pair of automatic inlet valves for each chemical batch tank.

4. The apparatus of claim 1 further comprising an additional discharge line pump connected to said discharge line as a back-up.

5. The apparatus of claim 1 further comprising a drain line connected to said discharge line and to a blended chemical recovery tank.

6. A chemical blending apparatus comprising:

(a) two chemical blending vessels for simultaneous blending and discharging of blended chemicals, with tops with inlets and cone shaped bottoms;

(b) a pair of automatic inlet valves connected to said inlets, one automatic inlet valve with a large inlet orifice and one automatic inlet valve with a relatively much smaller inlet orifice;

(c) a plurality of chemical batch tanks for holding chemicals to be blended, each chemical batch tank connected to said pair of automatic inlet valves;

(d) a pump connected to each chemical batch tank for high speed delivery of chemical from said chemical batch tank to said pair of automatic inlet valves;

(e) a weight cell means for measuring the weight of chemicals added to said chemical blending vessels, connected to each of said chemical blending vessels;

(f) a controller means for controlling the transfer of chemicals and opening and closing said automatic inlet valves, connected to said weight cell means; and (g) a discharge line connected to the bottom of each of said chemical blending vessels and to a receiving station, containing a static mixer, and connected to a discharge line pump and filter and a sampling means so that a resultant blend of chemicals is mixed, filtered, and sampled after discharge from said chemical blending vessels and prior to delivery to said receiving station.

7. The apparatus of claim 6 further comprising:

(a) at least one additional discharge line pump connected to and interconnecting said discharge lines as a backup; and (b) connections of said discharge lines to said chemical blending vessels so that said blended chemicals may be recirculated and mixed without delivery to said receiving station.

8. The apparatus of claim 6 further comprising a drain connected to each of said chemical blending vessels and to a blended chemical recovery tank.

9. A chemical blending method comprising the steps of:

(a) providing two chemical blending vessels with top inlets and coned bottoms;

(b) connecting a pair of automatic inlet valves to said top inlets, said pair of automatic inlet valves provided with one large inlet orifice and one with a relatively much smaller inlet orifice;

(c) connecting at least two chemical batch tanks for holding chemicals to be blended to each of said pairs of automatic inlet valves;

(d) connecting a pump to each of said chemical batch tanks, for high speed delivery of chemicals from said chemical batch tanks to said pairs of automatic inlet valves;

(e) connecting a weight cell means to each of said chemical blending vessels for measuring the weight of chemicals added to said chemical blending vessels;

(f) connecting a controller means for controlling the transfer of chemicals and opening and closing said pairs of automatic inlet valves, to said weight cell means;

(g) connecting a discharge line to the bottom of each of said chemical blending vessels and to a receiving station, and providing a static mixer, a discharge line pump, a filter and a sampling means within said discharge line so that a resultant blend of chemicals is mixed, filtered, and sampled after discharge from said chemical blending vessels and prior to delivery to said receiving station; and (h) operating said controller means so that said pump connected to said chemical batch tanks pumps a selected chemical at high speed through the automatic inlet valve with a large inlet orifice until such time as the weight cell means indicates that a majority of the selected chemical has been pumped to the chemical blending vessel when the controller means then directs the selected chemical to the automatic inlet valve with the relatively much smaller inlet orifice for high speed delivery of the remainder of the required chemical until such time as the weight cell means indicates that the proper weight for that selected chemical has been achieved at which point the controller means directs the addition of a second and following chemicals to the chemical blending vessel in a similar manner.

10. The method of claim 9 wherein the step of adding chemicals to be blended at high speed further comprises the step of adding chemicals at high speed through the automatic inlet valve with a large inlet orifice until such time as the weight cell means indicates that 97% of the selected chemical by weight has been added to the chemical blending vessel when the controller means automatically shuts off that automatic inlet valve and directs the remainder of chemical to be added at high speed through the automatic inlet valve with a relatively much smaller inlet orifice for the remainder 3% of chemical by weight.

11. The method of claim 9 further comprising the step of sequentially filling one chemical blending vessel and directing the blended chemical to the receiving station while at the same time filling the second chemical blending vessel so that continuous delivery of properly blended chemicals is provided to the receiving station.

12. The method of claim 9 further comprising the step of providing a drain connected to the bottom of each chemical blending vessel and to a blended chemical recovery tank for the draining and recapture of blended chemicals from said chemical blending vessels.

13. The method of claim 9 wherein the step of sampling further comprises the controller means closing the connection to the receiving station when the sample of the chemical blend does not match required specifications and operating the pumps from the appropriate chemical batch tank to correct the chemical blend to the proper requirements prior to opening the discharge line connection to the receiving station.

* * * * *